US012768624B2

(12) United States Patent
Gabliya et al.

(10) Patent No.: US 12,768,624 B2
(45) Date of Patent: Oct. 20, 2026

(54) AERODYNAMICALLY STABILIZED PROBE FOR A REMOTE-ACTING ELECTROSHOCK WEAPON

(71) Applicants: Yuriy Aleksandrovich Gabliya, Moscow (RU); Yuriy Olegovich Ladyagin, Moscow (RU)

(72) Inventors: Yuriy Aleksandrovich Gabliya, Moscow (RU); Yuriy Olegovich Ladyagin, Moscow (RU)

( * ) Notice: Subject to any disclaimer, the term of this patent is extended or adjusted under 35 U.S.C. 154(b) by 376 days.

(21) Appl. No.: 18/577,497

(22) PCT Filed: Sep. 20, 2021

(86) PCT No.: PCT/RU2021/000406
§ 371 (c)(1),
(2) Date: Nov. 22, 2024

(87) PCT Pub. No.: WO2023/282786
PCT Pub. Date: Jan. 12, 2023

(65) Prior Publication Data

US 2026/0118097 A1 Apr. 30, 2026

(30) Foreign Application Priority Data

Jul. 8, 2021 (RU) ..... RU2021120103

(51) Int. Cl.
*H02H 1/00* (2006.01)
*F41H 13/00* (2006.01)

(52) U.S. Cl.
CPC ..... *F41H 13/0025* (2013.01)

(58) Field of Classification Search
CPC ..... F41H 13/0025
See application file for complete search history.

(56) References Cited

U.S. PATENT DOCUMENTS 5,786,546 A * 7/1998 Simson ..... F41H 13/0025 102/293
7,950,329 B1 * 5/2011 Nemtyshkin ..... F42B 12/36 102/504

(Continued)

*Primary Examiner* — Stephen W Jackson
(74) *Attorney, Agent, or Firm* — Muncy, Geissler, Olds & Lowe, P.C.

(57) ABSTRACT

A stabilized probe for a remote-acting electroshock weapon comprises a current conducting or non-current conducting non-deformable or elastic casing with a device for attaching to a target, which is in the form of a barbed needle, inside which casing is a conducting wire arrangement in the form of a multi-layered self-supported coil with a conducting wire, and a weighting head made of a high-density metal, which is configured in the form of a tubular shell and to which at least one device for attaching to a target is radially attached. The conducting wire is arranged in layers with the coils touching one another. One end of the conducting wire is attached to the firing part of the electroshock weapon, and the other end of the conducting wire is disposed near to or is attached to the front face of the casing or to the device for attaching to a target. The end of the conducting wire extending out of the last upper layer of the arrangement is attached to the casing or to the head or is disposed near the head. The invention makes it possible to increase the precision with which the probes hit a target during firing.

3 Claims, 2 Drawing Sheets

(56) References Cited

U.S. PATENT DOCUMENTS

| | | | | |
|---|---|---|---|---|
| 10,690,455 | B2 * | 6/2020 | Salisbury | F41H 13/0025 |
| 11,609,071 | B1 * | 3/2023 | Pegouske | F42B 12/06 |
| 2005/0073796 | A1 * | 4/2005 | Smith | F41H 13/0031 361/232 |
| 2022/0163293 | A1 * | 5/2022 | Ladyagin | F41H 13/0025 |
| 2022/0325987 | A1 * | 10/2022 | Ladyagin | F41H 13/0025 |

* cited by examiner

AERODYNAMICALLY STABILIZED PROBE FOR A REMOTE-ACTING ELECTROSHOCK WEAPON

TECHNICAL FIELD OF THE INVENTION

The invention relates to remote-acting electroshock weapon (RESW) probes (projectiles) and can be used in non-lethal remote-acting electroshock weapons for law enforcement and citizens.

BACKGROUND OF THE INVENTION

A RESW projectile is known according to patent [1]. The projectile has a weighting head with a barbed needle and a flexible (easily deformable when the projectile strikes a target (offender, biological target, bio-target) casing, protecting the current conduit laying laid in its inner cavity, i.e. the compressed single-layer frameless coil of the current conduit forming after compression a dense mold in the form of a three-dimensional figure of spiral-shaped coils placed sequentially relative to the longitudinal axis of the hollow shell, the plane of which is perpendicular to this axis, from loss of disbanding (loss of the dense mold of the current conduit laying). The casing, as a rule, is made of paper having an adhesive surface facing the conducting wire laying and additionally holding it from disbanding. When the RESW is fired, the deformable casing with the conducting wire pressed inside it flies out of the firing part of the RESW. At the same time, the end of the conducting wire attached to the firing part of the RESW pulls the conducting wire out of the casing. During the flight of the projectile, the conducting wire is pulled out of the casing before the projectile hits the target and is attached to a target using a device for attaching the probe to a target (barbed needle). The disadvantage of the projectile is a relatively low helicity resulting from the destabilizing aerodynamic flow of air around the probe in flight due to precession of the probe as a result of complex processes of oscillations with rotation when pulling conducting wire from the cavity of the probe through the rear hole in the casing with aggravation of precession by the influence of the flat shape of the head part (which is an aerodynamic surface) changing the angle in the oncoming air flow in flight and the subsequent influence of flow oscillations from this surface on the yaw and pitch of the probe in flight.

The disadvantage of the projectile is also a small amount of conducting wire placed in it due to the fact that the coefficient of useful filling of the casing with conducting wire pressed from a single-layer frameless coil is not more than 0.8 [2], and in fact according to the results of serial production experience of RTEH-NO JSC even less. This disadvantage is aggravated by the fact that the barbed needle is 0.22 of the total length of the probe, thus reducing the possible for the given length of the probe at its maximum diameter volume of conducting wire laying (by 22%) and accordingly reducing the possible for the given volume of the probe volume length of the conducting wire stretched from it, i.e. the range of the shot.

According to the patent [3] the probe is known, consisting of a metal hollow casing (shell) with a metal weighting head with a barbed needle pressed in it. Inside the shell there is a conducting wire stacked layer by layer coil to coil. One end of conducting wire is fixed on the firing part of RESW and initially comes out of the hole formed by the first lower layer of multilayer laying when the probe is flying to the target, and the other end of conducting wire from the last upper layer of multilayer laying is attached to the head. When the RESW is fired, the hollow shell with the conducting wire flies out of the firing part of the RESW. At the same time, the end of the conducting wire attached to the firing part of the RESW pulls out the conducting wire placed in the hollow shell through the discharge washer welded on the rear end of the shell. During the flight of the projectile, the conducting wire is pulled out of the shell through the outlet washer until the projectile hits the target and is fixed on the target. The advantage of the probe is the increased amount (length of the deployed) of conducting wire as compared to the analog [1] as a result of the multilayer laying having the coefficient of useful filling of the casing with conducting wire more than 0.90-0.92 at varying the diameter of the laying wire. The disadvantage of the probe is that due to the complexity of the design of the probe has significant geometric dimensions and, accordingly, a large area of aerodynamic resistance due to the large diameter of the probe (F13.0 mm) in connection with what the probe quickly loses speed on the trajectory and to hit the target at maximum distances determined by the length of the stacked inside the conducting wire requires increased initial speeds. Besides, the conducting wire laid inside the probe comes out through the hole of the outlet washer of smaller diameter than the inner diameter of the probe casing, and this increases friction (reformation with bending of the conducting wire in the process of pulling) and, accordingly, the force of pulling the conducting wire out of the probe cavity, and the pulling force increases with pulling because of the need for bending reformation of the conducting wire from a large diameter to a small one, which requires compensation again by increasing the initial velocity of the probe. The increased initial velocity of the probe with a high impulse due to the large mass of the probe made almost entirely of metal and the large diameter (i.e., weight) of the shell always increases the injury rate when hitting the target at short distances (e.g., shooting at point-blank range). Another disadvantage of the probe is that its construction consists of at least three labor-intensive parts, a metal casing (shell) with a head with a barbed needle pressed into it and an exhaust washer pressed into the shell. The parts have to be made with high precision under rolling or with the use of high-tech micro-assembly operations. Due to the required precision manufacturing and high-tech operations using expensive equipment and highly skilled American specialists, the final price of the projectile is unreasonably high. A firing part of Axon Enterprise Inc's RESW with probes of this design costs $70-85 USD. Another disadvantage of the probe is relatively low helicity resulting from precession as a result of complex processes of oscillations with rotation when pulling the conducting wire from the probe cavity through the exhaust washer and aggravation of precession by the influence of the flat shape of the head part (which is an aerodynamic surface) changing the angle in the oncoming air flow during flight and the subsequent influence of flow oscillations from this surface on the yaw and pitch of the probe in flight.

Krnka-Hebler Bullets [4] for rifled weapons are known, and there are numerous studies and publications on the possible applications of tubular bullets, for example [5]. Bullets consist of a cylindrical tube-shaped body with one or another profile of outer and inner forming surface. The described tubular bullets studied for military applications have significant ballistic advantages at the supersonic speeds of interest to the military, such as increased compared to bullets and projectiles of classical designs, the range of direct fire, armor penetration at the same increased snagging of armor. Meyer bullet of the so-called arrow-turbine type for smoothbore weapons is known which is a body composed of cylinders of larger and smaller diameter having on the cylinder of smaller diameter weakly expressed obliquely placed blades of plumage with a through channel of decreasing from the head part of the conical cross-section with obliquely placed blades protrusions on the forming surface of the channel. [6]. The Meyer bullet has outstanding ballistic qualities for bullets intended for smoothbore weapons in terms of accuracy, but only when used at subsonic and maximum near-sonic velocities, as it was designed by A. K. Meyer for use with black powder charges or slow-burning smokeless powders at low muzzle pressures. At flight of Meyer bullets at sonic and supersonic speeds, incorrectly chosen shapes of the channel and the entrance edge cause throttling of supersonic flow passing through the channel, increasing aerodynamic resistance and destabilization of the bullet. Studies of the Meyer bullet (high-speed film and photography) showed that the Meyer bullet does not rotate in flight as intended by the author of the bullet organizing oblique external and internal blades. The Meyer bullet has a better stabilization rather than other designs of short (in contrast to long lancet bullets with attached wads and skirts) lancet bullets have which occurs due to complex interaction of external and internal air flows reducing the components of aerodynamic resistance arising during the flight of the bullet mainly at subsonic speeds. In addition, due to the tubular component Meyer bullet has less aerodynamic drag at subsonic velocities than bullets for smoothbore weapons of other designs, slower deceleration of velocity on the trajectory and, consequently, higher final kinetic energy. The use of tubular projectiles for stabilizing projectiles other than for combat or hunting weapons is unknown in the prior art.

The prototype of the proposed invention is the RESW projectile according to the patent [7], which has an elastic or easily deformable casing with conducting wire laying in the form of a multilayer frameless coil with a conducting wire laid layer by layer coil to coil. One end of the conducting wire is fixed on the firing part of the RESW and comes out of the hole formed by the first lower layer of the laying when the probe is flying to the target, and the other end of the conducting wire is fixed on the front end of the casing or on a device for attaching to a target and comes out of the last upper layer of the laying.

The advantage of the prototype consists in the increased quantity (maximum length of conducting wire stretched to the target) as compared to the analog [1] as a result of application of multilayer laying having the coefficient of useful filling of the casing with conducting wire 0.90-0.92. The advantage of the prototype in comparison with the analog [3] is in the low traumatic effect due to the lower required initial velocity because of the small aerodynamic resistance due to the small diameter (7.0-8.0 mm.), as well as due to the lack of a discharge washer with a small diameter of the conducting wire release and small energy losses for reformation with bending of the conducting wire in the process of pulling out of the shell cavity, and the small cost and simple manufacturability of production of the projectile. The main disadvantage of the projectile is its low accuracy because its head part has a low weight, so its aerodynamic stabilization by locating the center of gravity ahead of the center of resistance is insufficient. At the same time, its accuracy is not high because, as well as in analogs [1; 3] the projectile has precession as a result of complex processes of oscillations with rotation when pulling conducting wire from the cavity of the probe through the rear hole in the casing with aggravation of precession by the influence of predominantly flat or implicitly rounded shape of the head part (which is an aerodynamic surface) changing the angle in the oncoming air flow during flight and the subsequent influence of flow oscillations from this surface on the yaw and pitch of the probe in flight.

DISCLOSURE OF THE INVENTION

The technical problem consisting in impossibility to increase the firing accuracy of the probe by the prototype is solved by the claimed invention.

The technical result consists in increasing the accuracy of probes hitting the target during firing, which reduces serious injuries of offenders when probes that deviated randomly from the direction set by the RESW user hit the arteries and veins of the neck and face, eyes, or head (which causes generalized epileptic seizure with corresponding injuries and consequences, including those incompatible with life).

The goal is achieved by the fact that the stabilized remote-acting electroshock weapon probe contains a conductive or nonconductive non-deformable or elastic casing with a device for attaching to a target in the form of at least one barbed needle, with a conducting wire laid inside it in the form of a multilayer frameless coil with a conductor laid layer by layer coil to coil with one end of the conducting wire fixed on the firing part of the RESW and coming out of the hole formed by the first lower layer of the laying during the probe's flight to the target, and the other end of conducting wire, coming out of the last upper layer of laying and located near or fixed on the front end of the casing or device for attaching to a target, differing in that it has a head weighting from metals with high density, made in the form of a tubular shell, on which at least one device for attaching to a target is radially fixed, and the end of conducting wire, coming out of the last upper layer of laying, is fixed on the casing or head or located near the head.

An additional feature is that the probe with a nonconductive casing has a conductive insert, sticker or coating on the outside or inside of the forming casing connecting the front and rear ends of the probe.

An additional feature is that the probe has a single barbed needle fixed in the head at an angle to the axis of the shell.

EXECUTION OF THE INVENTION

Figure 1:
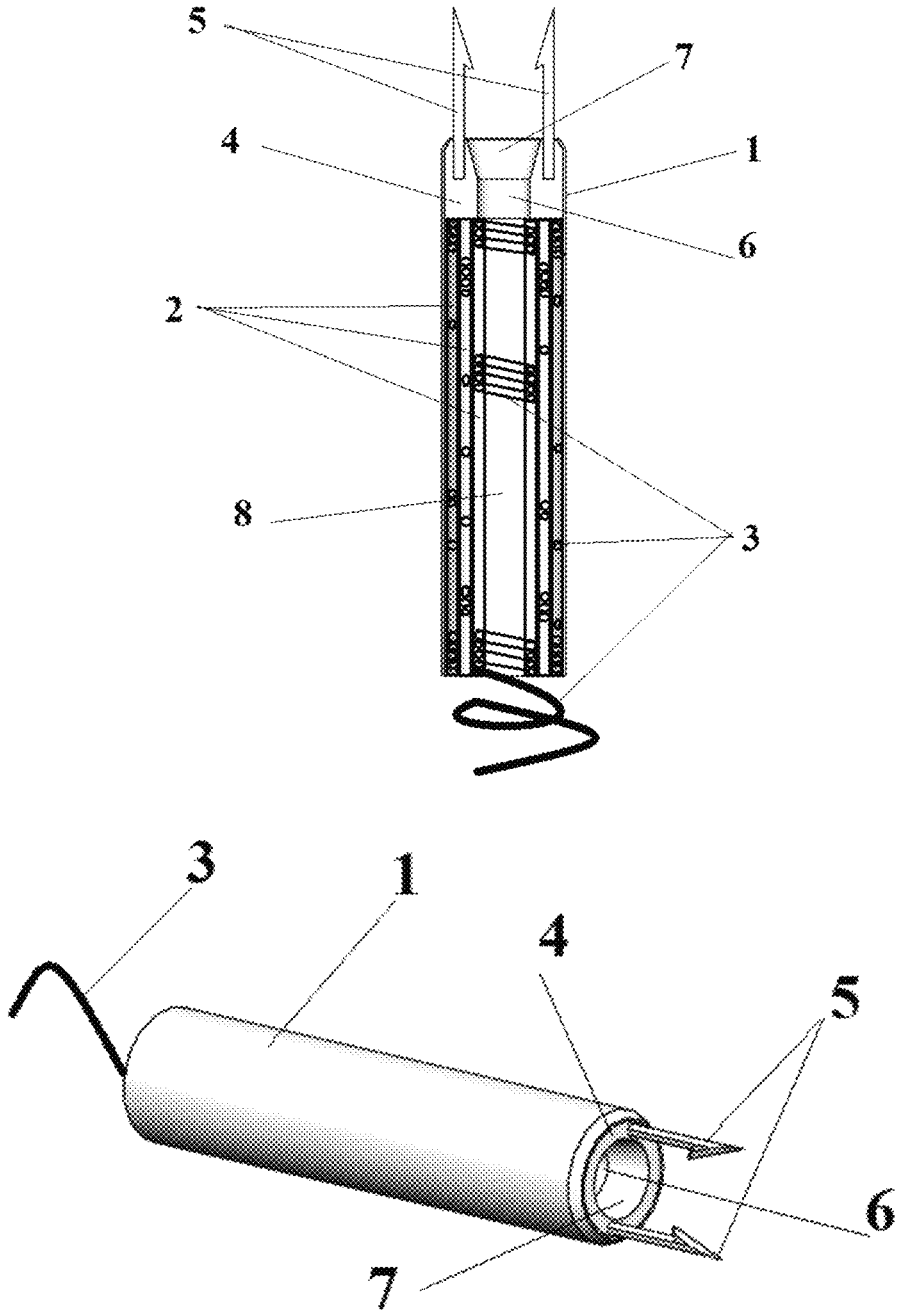
FIG. 1. Appearance and Section of an Aerodynamically Stabilized Probe.

FIG. 1. A stabilizable probe has a casing 1, a multilayer layup 2 of conducting wire 3, a tubular weighting head 4 and a device for attaching to a target placed in the head in the form of one or more barbed needles 5. The head 4 has a through channel 6 preferably having an entrance cone 7, and a channel 8 is provided along the probe and laying axis. The channel 8 in this type of laying is designed for free pulling of the conducting wire 3 out of the laying when the probe is flying to the target. The use of one or more needles depends on the diameter and length of the needle (i.e., the weight of the needle) with a needle of small weight can be used one needle installed on the circumference of the tubular shell of the head of the weighting device 4, with a needle with a large weight is preferable to install two needles located symmetrically relative to the axis of the probe to eliminate the possibility of violation of radial alignment with subsequent run-outs of the head of the weighting device with additional precession. FIG. 1 shows a probe with two needles 5. Additional stabilization of the RESW probe thrown from a smooth barrel of RESW firing cartridges in flight with respect to stabilization of probes of analogues and prototype is achieved due to complex aerodynamic interactions from air running over the head part of the probe at subsonic velocities of the probe flight of 40-60 m/s, passing of the air jet through the through channel 6 and the channel 8 expanding with the probe flight and pulling out of it the conducting wire 3. Thus, in the proposed invention, the conditions of air flow through the probe body are provided as in a tubular projectile. The air jet coming out of the rear end of the probe interacts with the air flow around the probe to center the probe in the surging flow. The probe may have either a conductive rigid (e.g., thin-walled metal tubing) or a non-current conducting elastic (e.g., heat shrinkable polymer tubing, paper or polymer duct tape).

Figure 2:
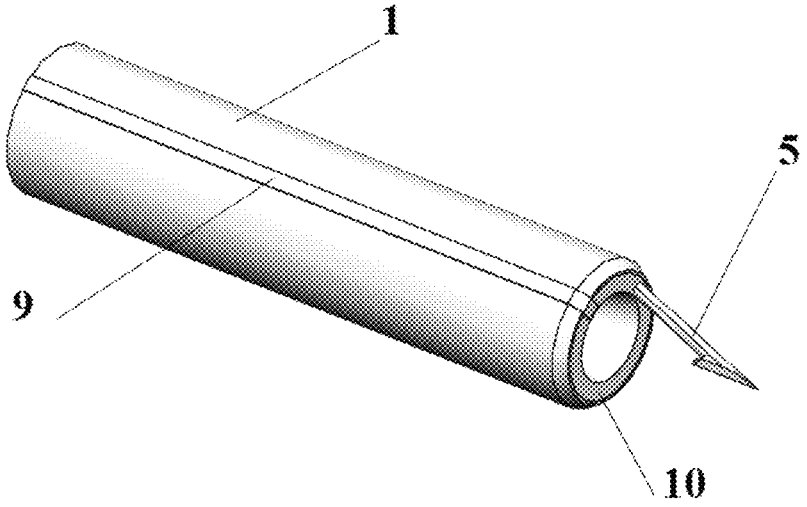
FIG. 2. Probe with Conductive Coating and Inclined Needle.

FIG. 2. In case of application of a non-current conducting shell in some RESW designs (RESW with high-voltage initiation of propellant charges [8]) for initiation of the propellant charge of the probes it is necessary that the probe head and the rear end of the casing shell have galvanic connection. In this case, in the claimed invention, a conductive coating 9 (metallic spraying or metallized conductive paint) or a conductive metallic copper or aluminum foil is applied to the nonconductive casing 1 outside or inside the casing. The conductive coating or foil connects the conductive head to the rear end of the shell of the probe to enable high-voltage initiation of the throwing charge of the probe. In the embodiment shown in FIG. 2, the barbed needle 5 in the weighting head 10 is fixed at an angle to the axis of the casing 1. This design of the needle attachment improves centering by reducing runout of the weighting head with additional precession when only one needle is used, as compared to mounting only one needle parallel to the probe axis instead of two as in FIG. 2. 1.

LIST OF CITED SOURCES

1. RU 2486451 C2
2. Yu. O. Ladyagin. Remote-acting electroshock weapon. M.: Stalingrad Foundation Publishing House, 2017, p. 186.
3. U.S. Pat. No. 10,690,455 B2 ELECTRODE FOR A CONDUCTED ELECTRICAL WEAPON
4. https://www.tandfonline.com/doi/abs/10.1080/03071849409416981?journalCode=rusi19
5. Naval Weapons Center China Lake Technical Memoradum 4106, Vol. 4, Advanced Armor Penetrator (Tubular Projectile), by L. Smith, et. al., pp. 25-26, December 1979.
6. https://ru.wikipedia.org/wiki/Пуля_Майера http://ohotnik.com.ua/Fire%20gun.htm
7. RU 2618849 C2 https://www.tandfonline.com/doi/abs/10.1080/03071849409416981?journalCode=rusi19
8. Yu. O. Ladyagin. Remote-acting electroshock weapon. M.: Stalingrad Foundation Publishing House, 2017, pp. 286-289.

The invention claimed is:

1. The stabilized remote-acting electroshock weapon probe, which contains a conductive or nonconductive non-deformable or elastic casing with a device for attaching to a target in the form of at least one barbed needle, with a conducting wire laid inside it in the form of a multilayer frameless coil with a conductor laid layer by layer coil to coil with one end of the conducting wire fixed on the firing part of the RESW and coming out of the hole formed by the first lower layer of the laying during the probe's flight to the target, and the other end of conducting wire, coming out of the last upper layer of laying and located near or fixed on the front end of the casing or device for attaching to a target, differing in that it has a head weighting from metals with high density, made in the form of a tubular shell, on which at least one device for attaching to a target is radially fixed, and the end of conducting wire, coming out of the last upper layer of laying, is fixed on the casing or head or located near the head.

2. The stabilizable probe according to item 1, differing in that the probe with a non-conductive casing has a conductive insert, sticker or coating on the outside or inside of the forming casing connecting the front and rear ends of the probe.

3. The stabilizable probe according to item 1, differing in that the barbed needle is fixed in the head-weighting device at an angle to the axis of the shell.

* * * * *